US012161918B2

(12) United States Patent
Ozaki et al.

(10) Patent No.: US 12,161,918 B2
(45) Date of Patent: Dec. 10, 2024

(54) GOLF CLUB HEAD

(71) Applicant: Sumitomo Rubber Industries, Ltd., Hyogo (JP)

(72) Inventors: Yohei Ozaki, Kobe (JP); Seiji Hayase, Kobe (JP); Masahide Onuki, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 57 days.

(21) Appl. No.: 18/075,806

(22) Filed: Dec. 6, 2022

(65) Prior Publication Data

US 2023/0173350 A1 Jun. 8, 2023

(30) Foreign Application Priority Data

Dec. 7, 2021 (JP) ..... 2021-198782

(51) Int. Cl.
*A63B 53/04* (2015.01)

(52) U.S. Cl.
CPC ..... *A63B 53/0408* (2020.08); *A63B 53/0433* (2020.08); *A63B 53/0437* (2020.08); *A63B 53/0466* (2013.01)

(58) Field of Classification Search
CPC ..... A63B 53/0437; A63B 53/0466; A63B 53/0433
See application file for complete search history.

(56) References Cited

U.S. PATENT DOCUMENTS 8,435,134 B2 * 5/2013 Tang ..... A63B 53/0466 473/332
9,216,324 B2 * 12/2015 Shear ..... A63B 53/0466
2008/0096689 A1 4/2008 Oyama
2014/0038745 A1 * 2/2014 Abe ..... A63B 53/0466 473/330
2019/0262669 A1 * 8/2019 Onuki ..... A63B 53/0466

FOREIGN PATENT DOCUMENTS

JP 4500296 B2 7/2010

* cited by examiner

*Primary Examiner* — Raeann Gorden
(74) *Attorney, Agent, or Firm* — Greenblum & Bernstein, P.L.C.

(57) ABSTRACT

A golf club head with a hollow therein comprises a face portion and a main body portion including a crown portion and a sole portion extending rearward from the face portion. The main body portion is provided with at least one slit penetrating through the main body portion. The slit has a width in the toe-heel direction and a length in the front-rear direction which is larger than the width. The surrounding area of the slit is at least partially provided with a thick portion.

18 Claims, 21 Drawing Sheets s1 cross section

Comparative Example

Example 1 (FIG.11)

Example 2 (FIG.12)

Example 3 (FIG.13)

Example 4 (FIG.14)

Example 5 (FIG.15)

GOLF CLUB HEAD

BACKGROUND OF THE INVENTION

Field of the Invention

The present disclosure relates to a golf club head having a hollow therein.

Background Art

Patent document 1 below discloses a wood-type golf club head in which the back surface of the face is virtually divided into nine areas in a checkerboard pattern, and the average thickness of each area is specified.

This golf club head is expected to have the effect of expanding the high repulsion area of the face portion in the toe-heel direction.

Patent Document 1: Japanese Patent No. 4,500,296

SUMMARY OF THE INVENTION

Problems to be Solved by the Invention

It is a primarily objective of the present disclosure to provide a golf club head in which, by using a different approach, the high repulsion area of the face portion can be expanded in the toe-heel direction without impairing the strength.

Means for Solving the Problems

According to the present disclosure, a golf club head has a hollow therein and comprises a face portion, and a main body portion including a crown portion and a sole portion both extending backwardly of the head from the face portion, wherein the main body portion is provided with a slit penetrating through the main body portion, the slit has a width in the toe-heel direction of the head and a length in the front-rear direction of the head which is larger than the width, and a surrounding area of the slit is at least partially provided with a thick portion.

Effects of the Invention

In the golf club head according to the present disclosure, by providing the slit configured as above, a high repulsion area of the face portion can be expand in the toe-heel direction, without impairing the strength.

DETAILED DESCRIPTION OF THE INVENTION

Figure 1:
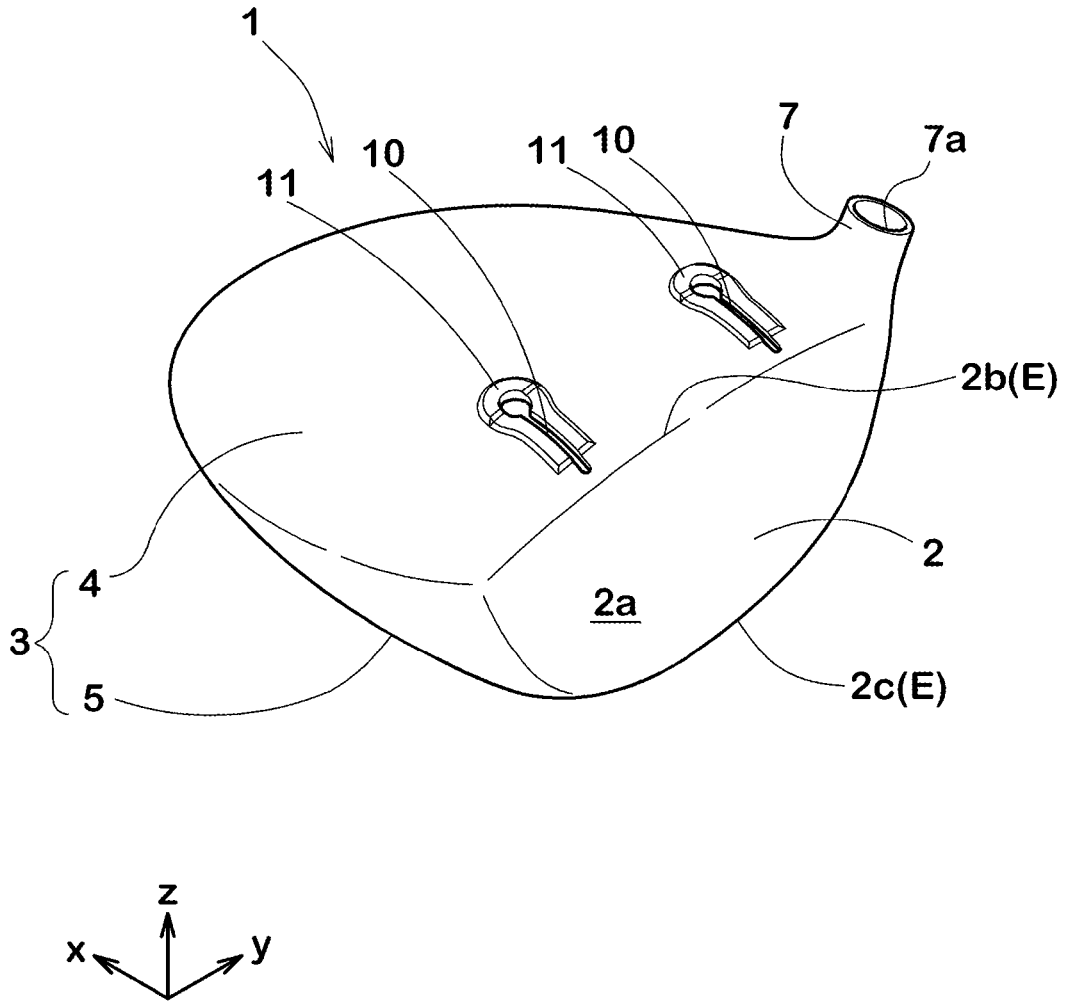
FIG. 1 is a perspective view of a golf club head as an embodiment of the present disclosure.

Embodiments of the present disclosure will now be described in detail in conjunction with accompanying drawings.

Throughout all the embodiments, the same reference numerals are assigned to the same members or portions, and redundant descriptions are omitted.

FIGS. 1 to 4 are a perspective view, a front view, a top view and a bottom view, respectively, of a golf club head 1 as an embodiment of the present disclosure.

Figure 3:
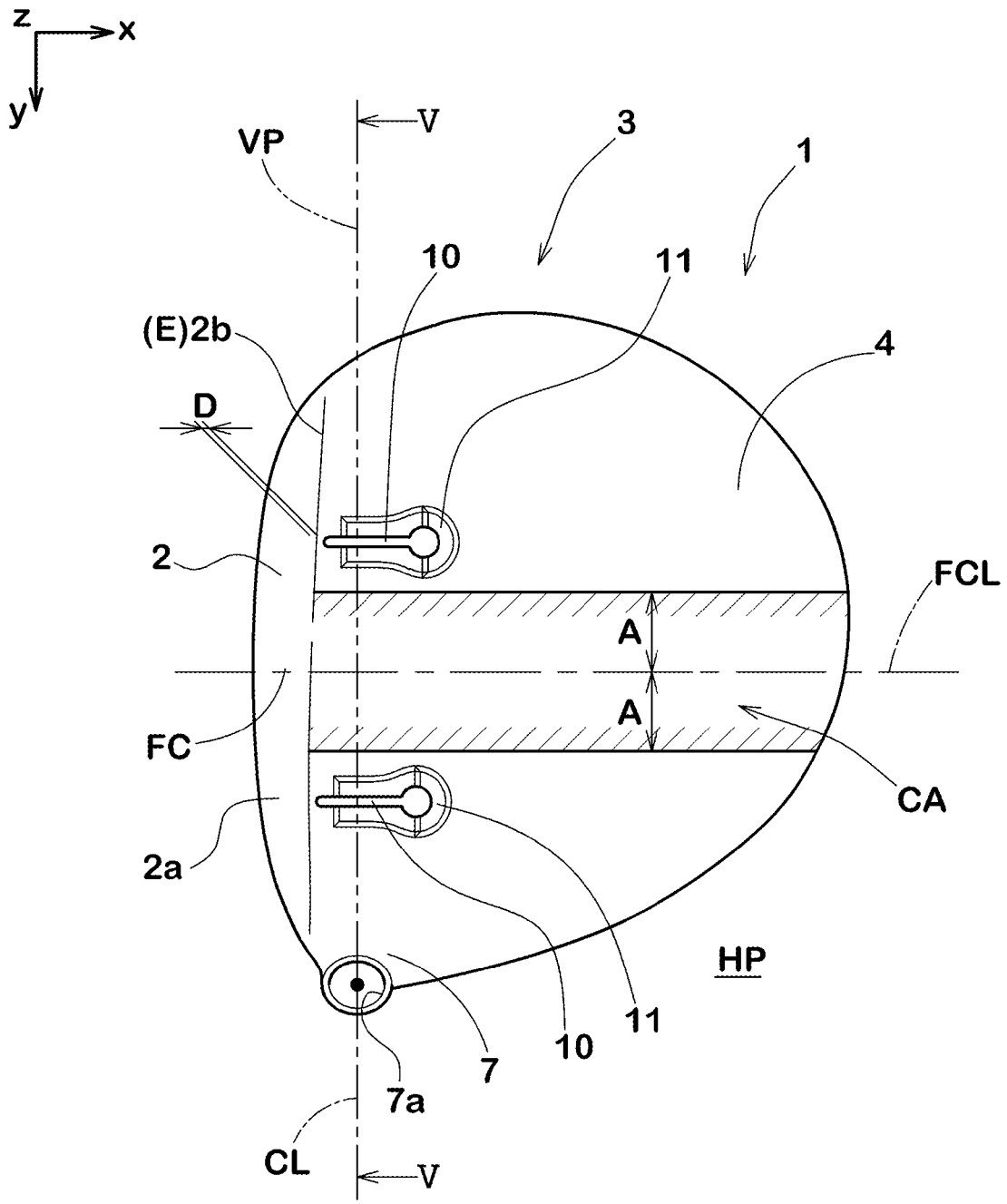
FIG. 3 is a top view thereof.
Figure 5:
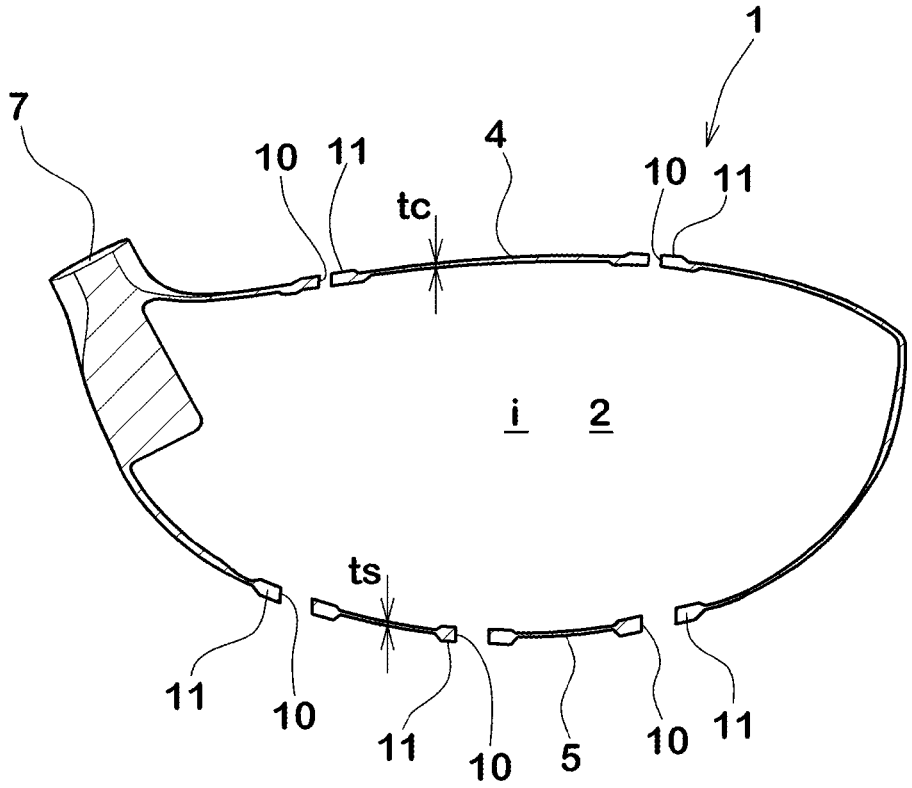
FIG. 5 is a cross-sectional view taken along line V-V of FIG. 3.

FIG. 5 is a cross-sectional view taken along line V-V of FIG. 3.

Figure 6:
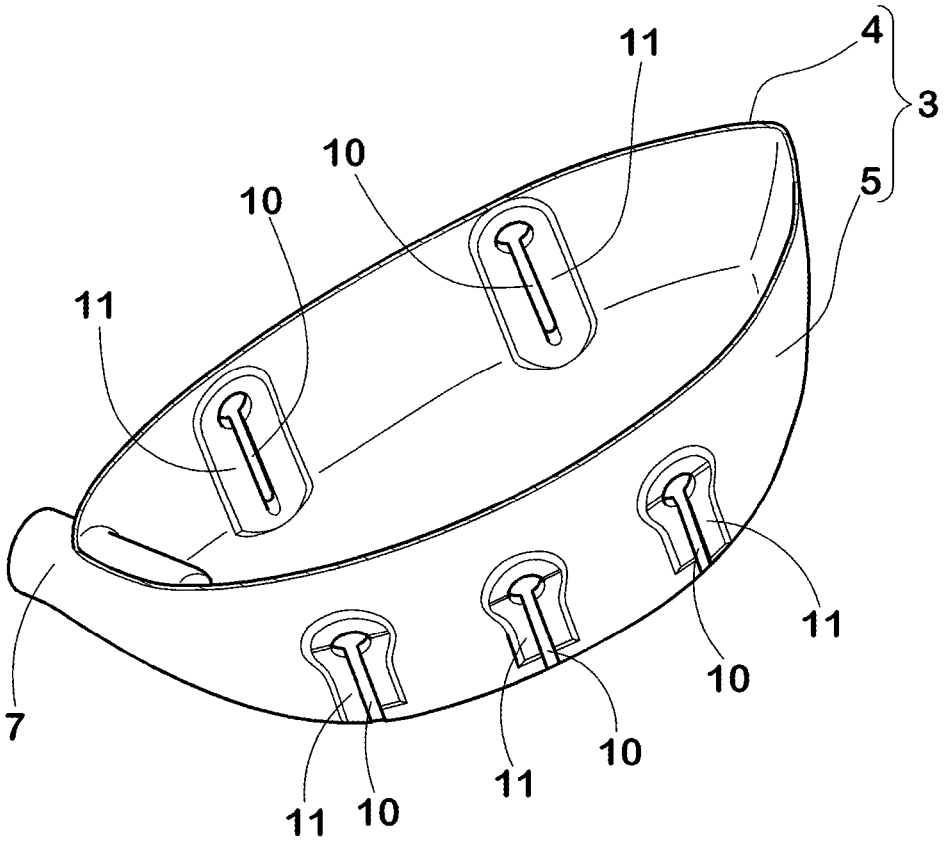
FIG. 6 is a perspective partial cross-sectional view of the golf club head.
Figure 7:
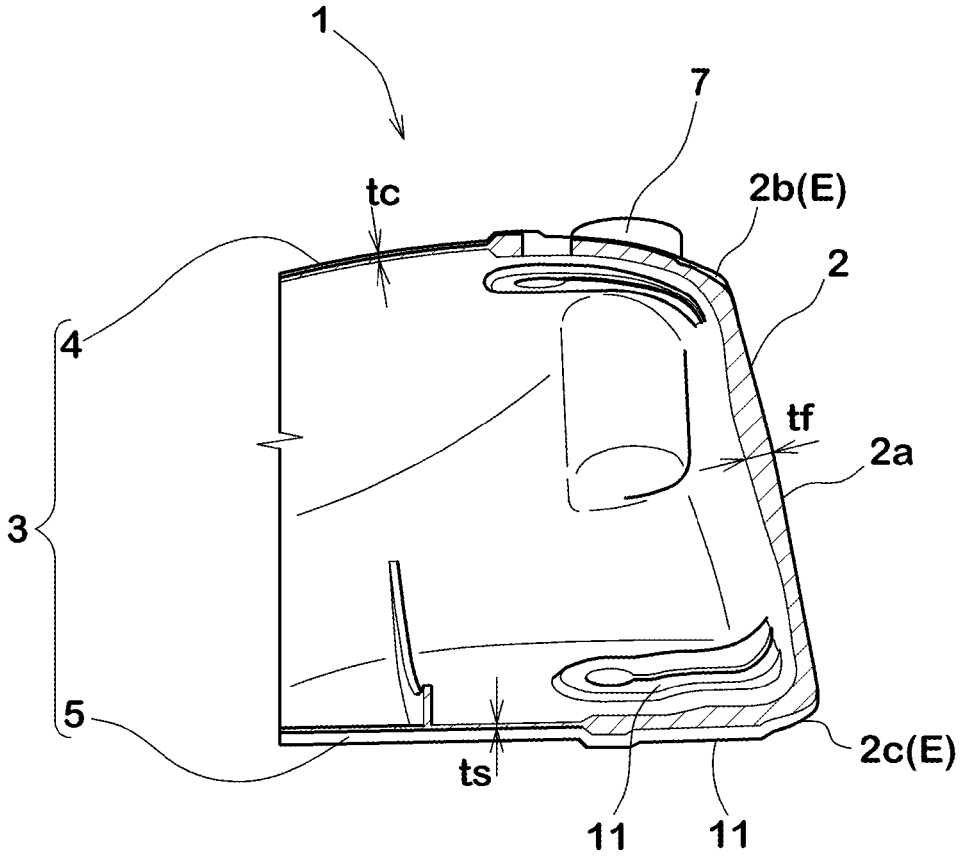
FIG. 7 is a partial cross-sectional view of the golf club head.

FIGS. 6 and 7 are various cross-sectional views of the head 1.

<<Reference State Etc.>>

In FIGS. 1 to 4, the head 1 is under its a reference state. The reference state is such a state that the head 1 is placed on a horizontal plane HP at a lie angle $\alpha$ (FIG. 2) and a loft angle (not shown) specified for the head 1, while keeping the shaft axis center line CL of the head 1 on a reference vertical plane VP.

The shaft axis center line CL is defined by the axis center line of a shaft insertion hole 7*a* formed in a hosel portion 7 of the head 1.

In this specification, the head 1 is assumed to be in this reference state, unless otherwise noted.

<<Head Coordinate System>>

In this specification, the head 1 is described in relation to an x-y-z orthogonal coordinate system. The x-axis is perpendicular to the reference vertical plane VP and parallel to the horizontal plane HP. The y-axis is parallel to both the reference vertical plane VP and the horizontal plane HP The z-axis is orthogonal to both the x-axis and the y-axis.

With respect to the head 1, the front-rear direction is a direction parallel to the x-axis, the toe-heel direction is a direction parallel to the y-axis, and the up-down direction is a direction parallel to the z-axis.

Regarding the front-rear direction of the head, the side of the face portion 2 is the front side, and the opposite side is the rear side.

<<Basic Configuration of Head>>

The head 1 in the present embodiment is essentially made of a metal material, and has a hollow i therein as shown in FIG. 5.

The hollow i of the head 1 may be left as a void space, or may be partially filled with a gel agent or the like in order to adjust the head weight, for example.

Suitable metal materials for the head 1 include stainless steel, maraging steel, titanium, titanium alloys, magnesium alloys, and aluminum alloys, for example.

Fiber reinforced resin may be used for part of the head 1.

As shown in FIGS. 1 to 4, the head 1 in the present embodiment is formed as a wood-type head. The wood-type head 1 includes heads for at least a driver, fairway wood, hybrid, etc., for example. The head 1 in the present embodiment is configured for a driver.

The head 1 comprises a face portion 2 and a main body portion 3 extending rearward from the face portion 2. These portions are formed of thin members, and form a hollow structure with a hollow i therein. Further, the main body portion 3 in this example includes at least a crown portion 4, a sole portion 5, and a hosel portion 7.

Figure 2:
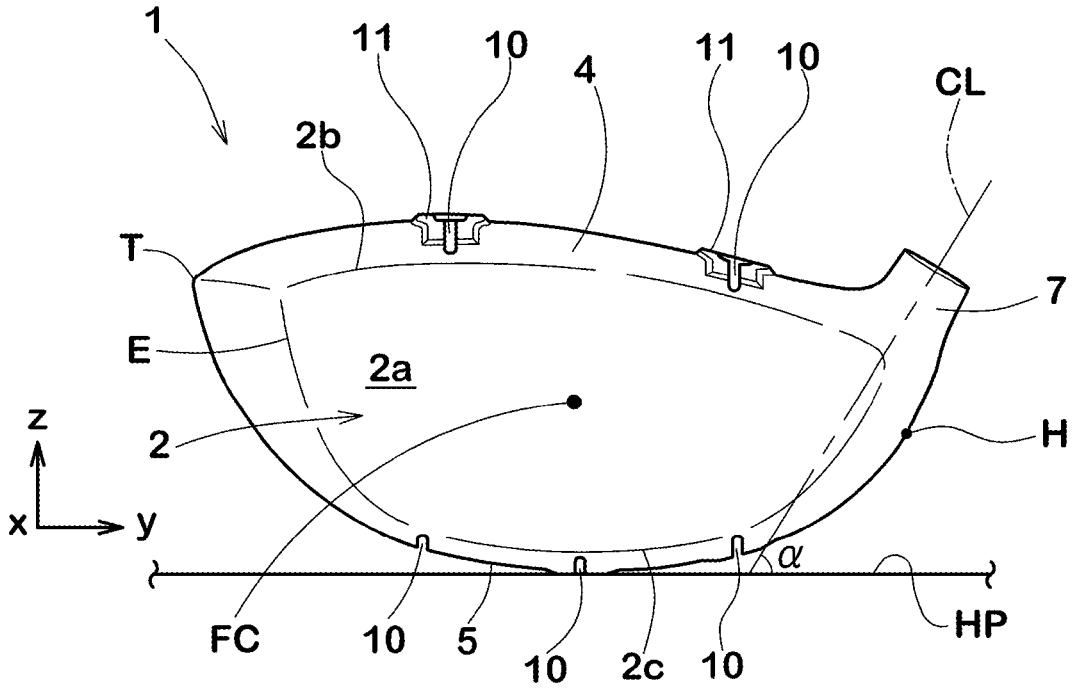
FIG. 2 is a front view thereof.

In FIG. 2, the symbol T indicates the toe of the head 1, and the symbol H indicates the heel of the head 1.

The face portion 2 is a portion for hitting a ball, formed on the front side of the head 1. The face portion 2 has a hitting surface 2*a* which comes into direct contact with the ball. The hitting surface 2*a* may be provided with face lines (not shown). The face lines are narrow grooves extending in the toe-heel direction.

The face portion 2 is made of a platy material having a relatively large thickness in order to prevent breakage when hitting a ball.

Preferably, the face portion 2 in this example has a thickness tf larger than that of the crown portion 4 as shown in FIG. 7. The thickness tf of the face portion 2 is, for example, 2.0 mm or more, preferably 2.2 mm or more, although not particularly limited thereto.

In order that the face portion 2 can be sufficiently bent when the ball hits, the thickness tf of the face portion 2 is, for example, 4.0 mm or less, preferably 3.8 mm or less.

The face portion 2 has a peripheral edge E which defines the boundary of the hitting surface 2*a*. When the peripheral edge E is visually recognizable as a clear ridge line, the peripheral edge E is defined by the ridge line.

If such ridge line is unclear due to smooth change in the curvature, a virtual peripheral edge line, which is defined based on the curvature change, is used instead as follows.

Figure 8A:
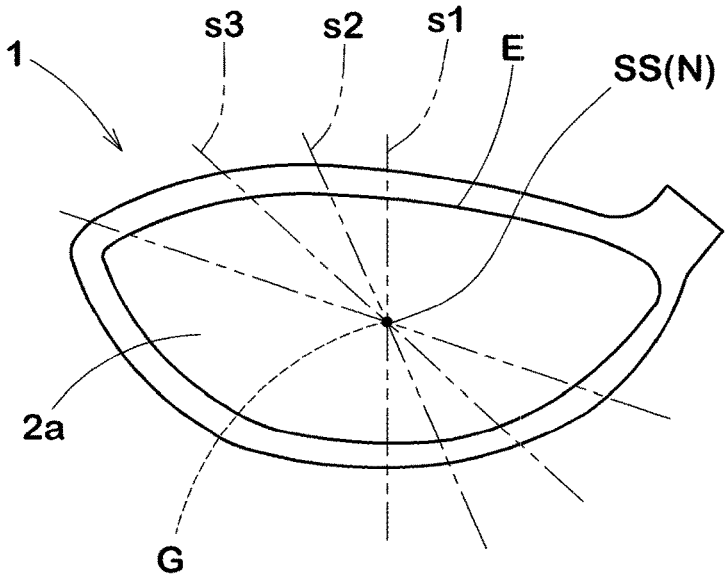
FIG. 8A and FIG. 8B are a front view of a golf club head and a cross-sectional view taken along line s1 for explaining the peripheral edge of the ball hitting surface.
Figure 8B:
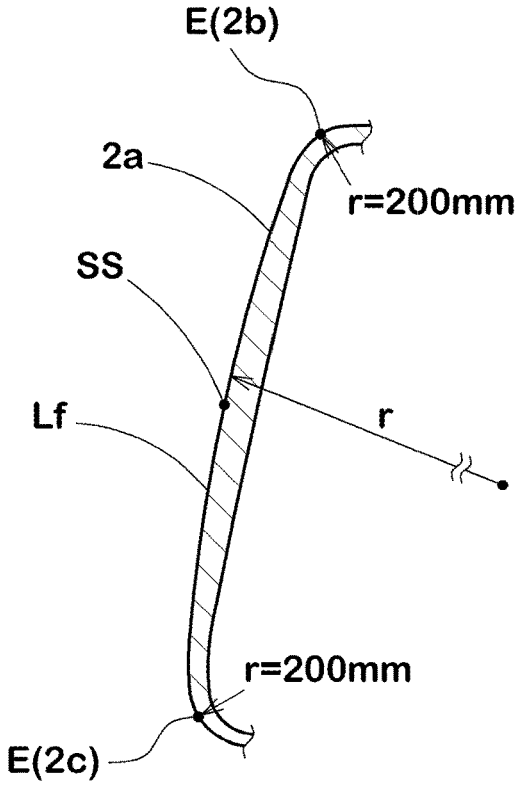

As shown in FIG. 8A, in each cutting plane s1, s2, s3—including a straight line N drawn between the sweet spot (centroid) SS and the center of gravity G of the head, as shown in FIG. 8B, a point E at which the radius (r) of curvature of the profile line Lf of the face portion first becomes under 200 mm in the course from the sweet spot SS to the periphery of the club face is determined. Then, the virtual peripheral edge is defined as a locus of the points E.

Of the peripheral edge E, a boundary with the crown portion 4 is the upper edge 2*b* of the face portion 2, and a boundary with the sole portion 5 is the lower edge 2*c* of the face portion 2.

The crown portion 4 extends rearward of the head from the upper edge 2*b* of the face portion 2 and forms the upper surface of the head.

The hosel portion 7 is located on the heel side of the crown portion 4, and provided with a shaft insertion hole 7*a* in which a shaft (not shown) is inserted and fixed.

In the top view of the head as shown in FIG. 3, the crown portion 4 is a portion excluding the face portion 2 and the hosel portion 7.

The crown portion 4 in this example has a substantially constant reference thickness tc as shown in FIGS. 5 and 7, excepting a thick portion 11 which will be described later. Although the reference thickness tc of the crown portion 4 is not particularly limited, from the viewpoint of improving the rebound performance, it is preferably set in a range of 1.0 mm or less, more preferably 0.7 mm or less, and from the viewpoint of durability, it is preferably set in a range of 0.2 mm or more, more preferably 0.3 mm or more.

Figure 4:
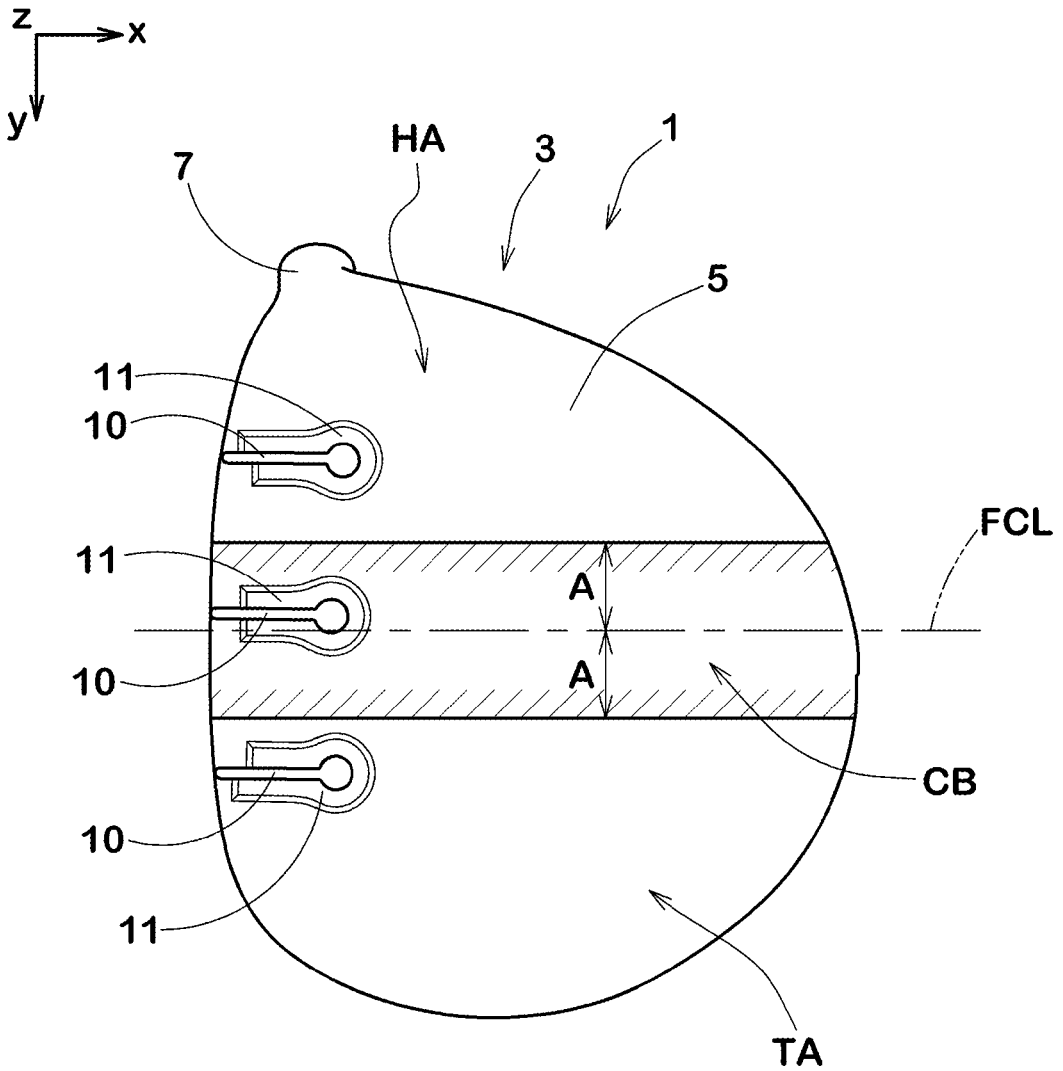
FIG. 4 is a bottom view thereof.

As shown in FIGS. 1 and 4, the sole portion 5 extends rearward from the lower edge 2*c* of the face portion 2, and forms the bottom surface of the head.

In the bottom view of the head, the sole portion 5 is a portion excluding the hosel portion 7.

As shown in FIGS. 5 and 7, the sole portion 5 is formed with a substantially constant reference thickness ts, excepting a thick portion 11 which will be described later. Although the reference thickness ts of the sole portion 5 is not particularly limited, from the viewpoint of improving the rebound performance, it is preferably set in a range of 1.5 mm or less, more preferably 1.0 mm or less, and from the viewpoint of durability, it is preferably set in a range of 0.3 mm or more, more preferably 0.5 mm or more.

<<Slit and Thick Portion>>

In the head 1 of the present embodiment, the main body portion 3 is provided with at least one slit 10 penetrating through the main body portion 3.

In the present embodiment, each of the crown portion 4 and the sole portion 5 is provided with at least one slit 10. In the present embodiment, each of the crown portion 4 and the sole portion 5 is provided with a plurality of slits 10.

As further modifications, only the crown portion 4 or only the sole portion 5 may be provided with at least one slit 10.

Further, the crown portion 4 may be provided with only one slit 10.

Furthermore, the sole portion 5 may be provided with only one slit 10.

Figure 9:
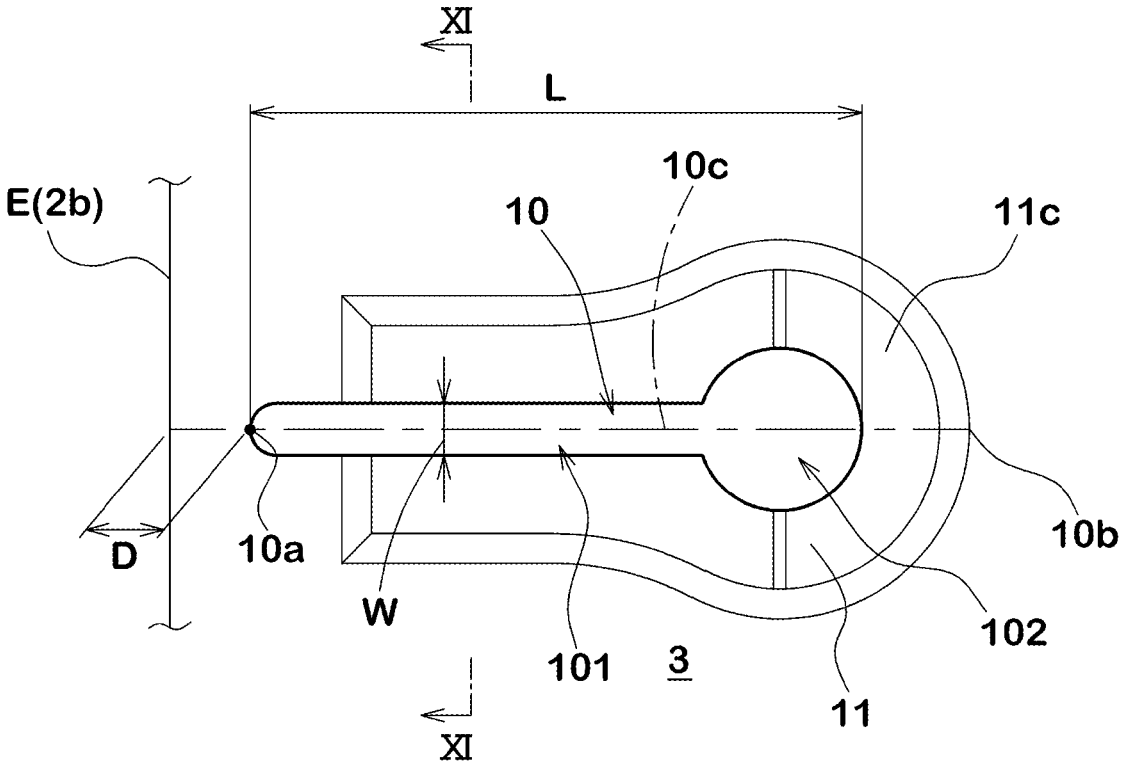
FIG. 9 shows one of the slits and its surrounding portion shown in FIG. 4.

FIG. 9 enlargedly shows one of the slits 10 shown in FIG. 3.

As shown, the slit 10 has a length L in the front-rear direction of the head, and a width W in the toe-heel direction of the head.

In each of the slits 10 in the present embodiment, the length L is larger than the width W. Thus, the slit 10 extends long in the front-rear direction than in the toe-heel direction.

Such slit 10 locally reduces the rigidity in the toe-heel direction, of the main body portion 3 (for example, the crown portion 4 or the sole portion 5). Therefore, when hitting a ball, the main body portion 3 is easily bent in the toe-heel direction.

In the head 1 of the present embodiment, the above-mentioned thick portion 11 is formed at least partly around the slit 10.

In the present embodiment, the thick portion 11 is formed adjacently to the slit 10.

In the present embodiment, the thick portion 11 is formed by locally increasing the thickness of the main body portion 3 as shown in FIG. 5.

Thus, around the thick portion 11, there is formed a portion having a smaller thickness than the thick portion 11.

Operation of the Present Embodiment

When a ball hits the hitting surface 2*a* of the face portion 2, the crown portion 4 and the sole portion 5 which are connected to the face portion 2 are complexly deformed. Specifically, when hitting a ball, the crown portion 4 undergoes bending deformation in the front-rear direction and tensile deformation in the toe-heel direction. The sole portion 5 also undergoes deformations similar to the crown portion 4.

As a result of various researches conducted by the inventors, it was found that, when the tensile rigidity in the toe-heel direction of the main body portion 3 is lowered, it is possible to improve the rebound performance of the head 1 when the ball hitting position is near the slit, therefore, by providing a slit extending in the front-rear direction of the head in the main body portion 3 and adjusting the thickness of the face to be thicker, the high repulsion area of the face portion can be effectively expanded in the toe-heel direction without changing the maximum coefficient of restitution of the head 1.

Based on the above findings, in the head 1 of the present embodiment, the main body portion 3 is provided with the slits 10 extending in the front-rear direction of the head. As a result, when a ball hits the face portion, the main body portion 3 is largely elastically deformed in the toe-heel direction, starting from the slit 10, and the high repulsion area of the face portion 2 is expanded in the toe-heel direction. Therefore, in the head 1 of the present embodiment, even when the ball hits the toe side portion or heel side portion of the hitting surface 2*a*, the decrease in the flight distance of the ball can be minimized.

On the other hand, when the ball hits the face portion, the main body portion 3 (especially the area around the slit 10) is likely subjected to large stress as a result of bending stress due to the bending deformation in the front-rear direction, and tensile stress due to the tensile deformation in the toe-heel direction.

In order to maintain the strength of the head 1, the head 1 of the present disclosure is provided with a thick portion 11 at least partly around each slit 10. The thick portion 11 can disperse the stress around the slit 10 and suppress a significant local increase in stress.

A more preferred embodiment of the present disclosure will be described below.

<<Minimum Distance Between Slit and Periphery of Face>>

The slit 10 has a front end 10*a* and a rear end 10*b* in the front-rear direction of the head as shown in FIG. 9. The front end 10*a* and the rear end 10*b* are positioned on the most front side and the most rear side of the slit 10, respectively.

The shortest distance D between the front end 10*a* of the slit 10 and the peripheral edge E of the face portion 2 is preferably 10 mm or less, more preferably 3 mm or less, still more preferably 1 mm or less.

At the peripheral edge E of the face portion 2, there is formed a corner where the face portion 2 and the main body portion 3 are connected. Such a corner has high rigidity, and deforms relatively little even when a ball is hit.

Therefore, when the front end 10*a* of the slit 10 is brought close to the peripheral edge E, the increase in stress occurring in the vicinity of the front end 10*a* of the slit 10 is effectively suppressed.

<<Contour Shape of Slit>>

In a plan view of the slit 10 as shown in FIG. 9, it is preferable that the front end 10*a* and/or the rear end 10*b* have an arcuate contour. In this way, the slit 10 does not have sharp corners near the front end 10*a* and the rear end 10*b*, therefore, stress concentration thereon can be suppressed. In the present embodiment, both the front end 10*a* and the rear end 10*b* are arcuate.

Preferably, the width of the slit 10 is larger on the rear end 10*b* side than on the front end 10*a* side.

According to experiments conducted by the inventors, the tensile deformation in the toe-heel direction, of the crown portion 4 and the sole portion 5 which occurs when hitting a ball, tends to increase as the distance from the peripheral edge E of the face portion 2 toward the rear of the head increases.

However, by making the width of the slit 10 on the rear end 10*b* side larger than the width of the slit 10 on the front end 10*a* side, the increase in stress near the rear end 10*b* of the slit 10 can be effectively suppressed.

The slit 10 of the present embodiment comprises a first portion 101 extending rearward of the head from the front end 10*a*, and a second portion 102 connected to the rear end of the first portion 101 and having a circular contour.

As shown in FIG. 9, in the first portion 101, the width W of the slit 10 is constant except for the front end portion.

In the second portion 102, the width W of the slit 10 is larger than the constant width of the first portion 101.

Such slit 10 can effectively suppress an increase in stress in the vicinity of the rear end 10*b* of the slit 10 where deformation of the main body portion 3 tends to increase.

The maximum width at the second portion 102 is preferably 1.5 times or more, more preferably 2.0 times or more the constant width of the first portion 101.

<<Length and Width of Slit>>

In order that the slit 10 effectively promotes the bending of the main body portion 3 in the toe-heel direction, the length L of the slit 10 is set to be 10 mm or more, preferably 12 mm or more, more preferably 15 mm or more.

On the other hand, if the length L of the slit 10 increases, the durability of the main body portion 3 may be decreased, therefore, the length L is preferably set to be 40 mm or less, more preferably 30 mm or less, still more preferably 25 mm or less.

In order that the slit 10 effectively promotes the bending of the main body portion 3 in the toe-heel direction, the width W of the slit 10 is set to be 0.5 mm or more, preferably 1 mm or more, more preferably 2 mm or more.

On the other hand, if the width W of the slit 10 increases, the durability of the main body portion 3 may be decreased, therefore, the width W is preferably 10 mm or less, more preferably 8 mm or less, still more preferably 6 mm or less.

The width W of the slit 10 may vary as shown in FIG. 9, but may be constant except for end portions.

<<Angle of Slit>>

In the top view or bottom view of the head, a reference straight line 10*c* of the slit 10 is defined as extending between the front end 10*a* and the rear end 10*b* of the slit 10.

Preferably, the reference straight line 10*c* is inclined at an angle of 15 degrees or less with respect to the front-rear direction of the head (or the x-axis).

Such slit 10 can effectively promote the bending of the main body portion 3 in the toe-heel direction when the ball hitting position is toe-side or heel-side of the sweet spot.

In order to more effectively promote the bending of the main body portion 3 in the toe-heel direction, the angle of the reference straight line 10*c* of the slit 10 is set to be 10 degrees or less, more preferably 5 degrees or less.

When the reference straight line 10*c* is inclined with respect to the front-rear direction of the head, the inclination direction of the reference straight line 10*c* is not particularly limited. Although the slit 10 in the present embodiment extends linearly in parallel with the front-rear direction of the head, the slit 10 may have a non-linear shape such as an arc shape, a zigzag shape, or a wavy shape.

<<Cover of Slit>>

The slit 10 may be provided with a cover (not shown) made of an elastic material such as rubber, resin, elastomer and the like. Such cover can prevent foreign matters from entering the hollow i of the head 1 without hindering the deformation of the main body portion 3.

Preferable Example of Thick Portion

Figure 10:
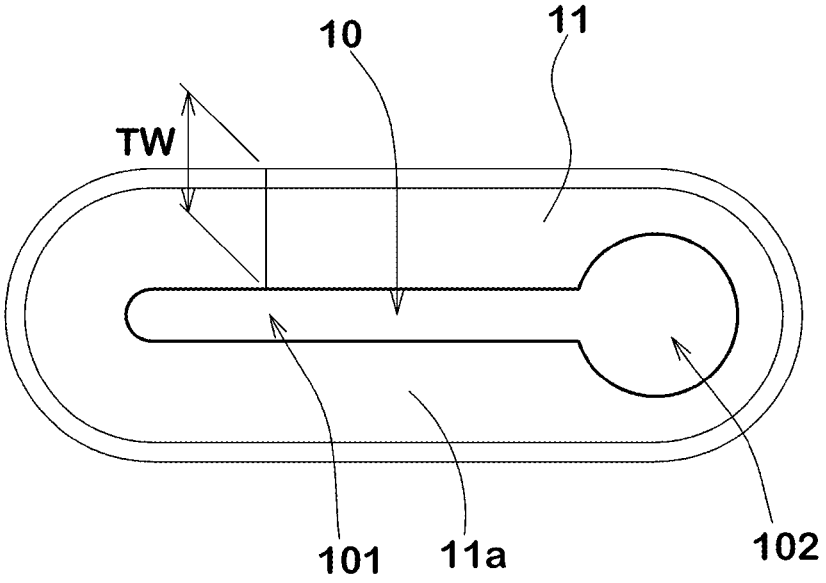
FIG. 10 shows the back side of the slit shown in FIG. 9 viewed from the inside of the head.
Figure 11:
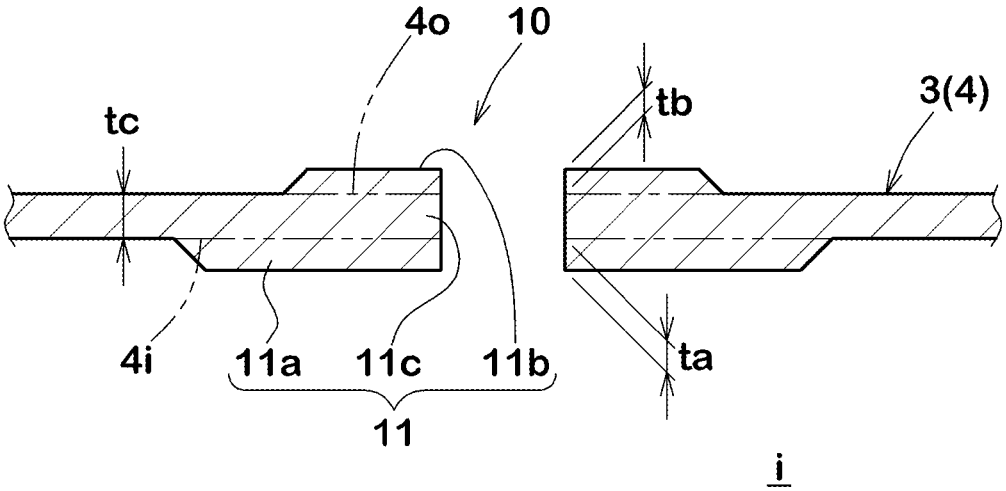
FIG. 11 is a cross-sectional view taken along line XI-XI of FIG. 9 showing the thick portion.

FIG. 10 shows the back side of the slit 10 shown in FIG. 9 viewed from the inside of the head. FIG. 11 is a cross-sectional view along line XI-XI of FIG. 9. As shown in FIGS. 9 to 11, the thick portion 11 of the present embodiment is formed annularly so as to surround the slit 10. Such thick portion 11 is more effective in relieving the stress of the main body portion 3 around the slit 10.

The thick portion 11 of the present embodiment includes an inside thick portion 11*a* protruding toward the hollow i. The inside thick portion 11*a* protrudes toward the hollow i from the inner surface 4*i* of a reference thick portion 11*c* which is defined by the reference thickness tc of the crown portion 4. Thus, the boundary in the thickness direction between the inside thick portion 11*a* and the reference thick portion 11*c* is an imaginary boundary defined by smoothly extending the inner surface 4*i* of the reference thick portion 11*c* to the slit 10.

As shown in FIG. 10, the inside thick portion 11*a* continues annularly around the slit 10. As a result, an increase in stress when hitting a ball is suppressed over the entire circumference of the slit 10.

Moreover, as is clear from FIG. 10, the inner edge of the inside thick portion 11*a* coincides with the contour or edge of the slit 10.

The thickness ta of the inside thick portion 11*a* is not particularly limited. But, in order to sufficiently exert the effect of reducing the stress in the slit surrounding portion, the thickness ta is preferably 0.5 mm or more, more preferably 1.0 mm or more, still more preferably 1.5 mm or more.

On the other hand, in order to suppress an increase in the weight of the head 1, the thickness ta of the inside thick portion 11*a* is preferably 5.0 mm or less, more preferably 4.0 mm or less, still more preferably 3.0 mm or less.

The thick portion 11 of the present embodiment may further include an outside thick portion 11*b* protruding toward the outside of the head.

The thick portion 11 may consist of the outside thick portion 11*b* and/or the inside thick portion 11*a*.

The outside thick portion 11*b* protrudes toward the outside of the head from the outer surface 4*o* of the above-mentioned reference thick portion 11*c* defined by the reference thickness tc of the crown portion 4.

The boundary in the thickness direction between the outside thick portion 11*b* and the reference thick portion 11*c* is an imaginary boundary defined by smoothly extending the outer surface 4*o* of the reference thick portion 11*c* to the slit 10.

As shown in FIG. 9, in the present embodiment, the outside thick portion 11*b* is interrupted at a portion around the slit 10.

Specifically, the outside thick portion 11*b* is not formed around the front portion of the slit 10 including the front end 10*a*.

The front end 10*a* of the slit 10 is located near the face portion's peripheral edge E where the rigidity is relatively high, therefore, even if the outside thick portion 11*b* is not provided in such portion, the increase in the stress in the vicinity of the front end 10*a* can be suppressed.

Further, by partially eliminating the outside thick portion 11*b*, the corresponding weight is reduced which helps to reduce the weight of the head. In particular, the weight reduction in the crown portion 4 is preferable.

Further, as is clear from FIG. 9, the inner edge of the outside thick portion 11*b* coincides with the contour or edge of the slit 10.

The thickness tb of the outside thick portion 11*b* is not particularly limited. But, in order to sufficiently exhibit the effect of reducing the tensile stress in the toe-heel direction around the slit, the thickness tb of the outside thick portion 11*b* is preferably 0.5 mm or more, more preferably 1.0 mm or more, still more preferably 1.5 mm or more. On the other hand, if the thickness tb is too large, the bending rigidity in the front-rear direction of the head increases, and as a result, the bending stress in the front-rear direction of the head is increased.

Therefore, in order that the effect of reducing the bending stress in the front-rear direction occurred around the slit can be fully exerted while suppressing the increase in the weight of the head 1, the thickness tb of the outside thick portion 11*b* is preferably set to be 5.0 mm or less, more preferably 4.0 mm or less, still more preferably 3.0 mm or less.

The widths TW of the inside thick portion 11*a* and the outside thick portion 11*b* are not particularly limited. But, in order to sufficiently exert the effect of reducing the stress around the slit, such widths are preferably set to be 1.0 mm or more, more preferably 2.0 mm or more, still more preferably 3.0 mm or more.

Further, in order to suppress the weight increase of the head 1, the widths TW of the inside thick portion 11*a* and the outside thick portion 11*b* are preferably set to be 15.0 mm or less, more preferably 12.0 mm or less, still more preferably 10.0 mm or less.

Here, the width TW is measured in a direction perpendicular to the edge of the slit 10.

<<Cross-Sectional Shape of Thick Portion>>

As to the cross-sectional shape of the thick portion 11, various shapes can be employed.

In the example of FIG. 11, the thickness to of the inside thick portion 11*a* is substantially constant at 0.75 mm. The outer edge portion of the inside thick portion 11*a* is continuously decreased in the thickness and merged into the reference thick portion 11*c*. Further, the thickness tb of the outside thick portion 11*b* is substantially constant at 0.50 mm.

The outer edge portion of the outside thick portion 11*b* is continuously decreased in the thickness and merged into the reference thick portion 11*c*.

Regarding the width TW of the thick portion, the width of the inside thick portion 11*a* is larger than the width of the outside thick portion 11*b*.

This can be utilized to suppress the position of the center of gravity G of the head from becoming higher by making the volume of the outside thick portion 11*b* smaller than the volume of the inside thick portion 11*a*.

FIGS. 12 to 15 show various examples of the cross-sectional shapes of the thick portion 11. These cross sections are those at positions correspond to the line XI-XI of FIG. 9. In these examples as well, it is possible to effectively reduce the stress around the slit 10 when the ball is hit.

Figure 12:
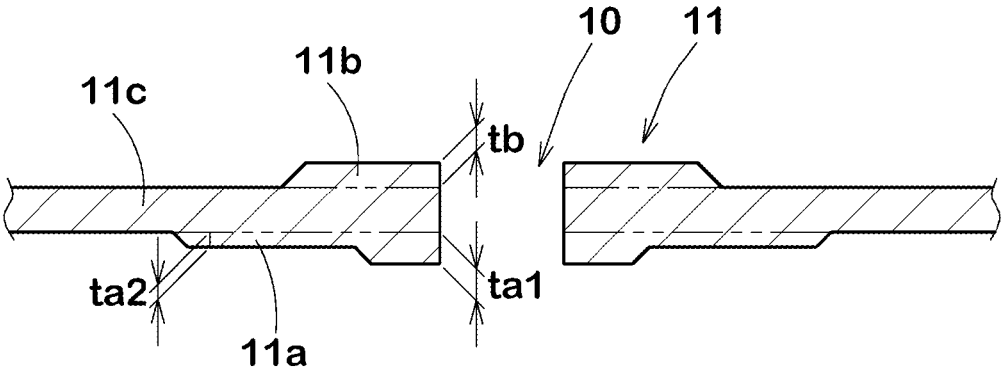
FIGS. 12, 13, 14 and 15 are cross-sectional views each showing another example of the thick portion, taken at the corresponding position to that in FIG. 11.

In the example of FIG. 12, the thickness of the inside thick portion 11*a* is changed stepwise so that the thickness ta1 on the slit 10 side is larger than the thickness ta2 on the outer edge side thereof. The outside thick portion 11*b* is the same as that shown in FIG. 11

Figure 13:
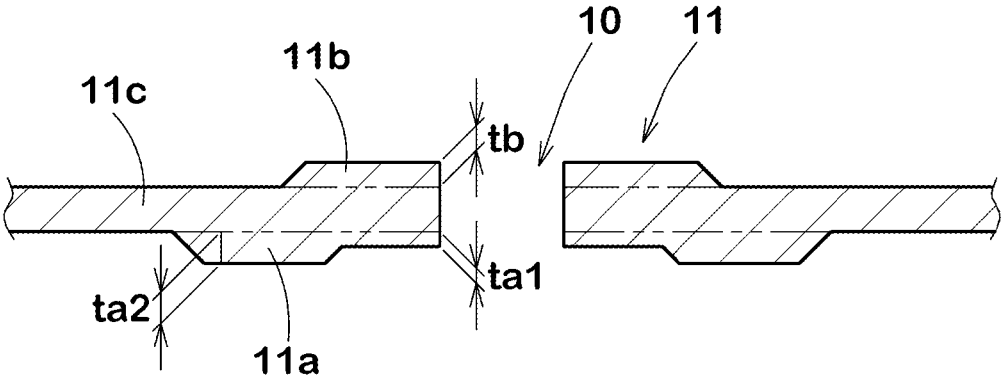

In the example of FIG. 13, the thickness of the inside thick portion 11*a* is changed stepwise so that the thickness ta1 on the slit 10 side is smaller than the thickness ta2 on the outer edge side thereof. The outside thick portion 11*b* is the same as that shown in FIG. 11.

Figure 14:
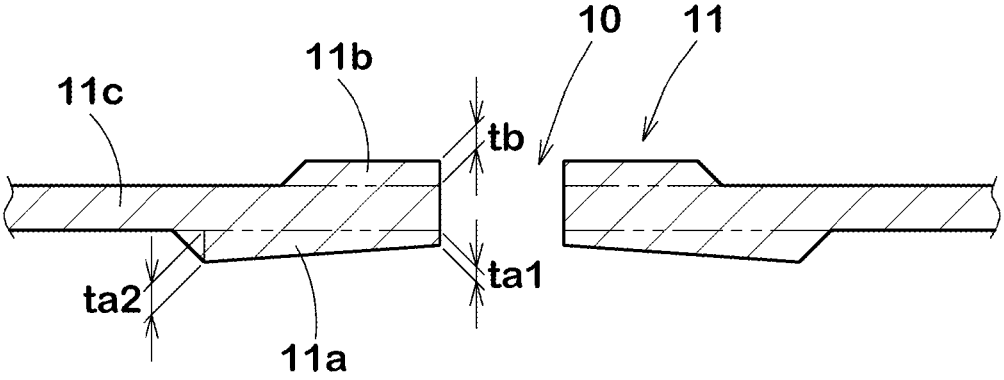

In the example of FIG. 14, the inside thick portion 11*a* continuously increases from a minimum thickness ta1 on the slit 10 side to a maximum thickness ta2 on the outer edge side of the inside thick portion 11*a*. The outside thick portion 11*b* is the same as in FIG. 11.

Figure 15:
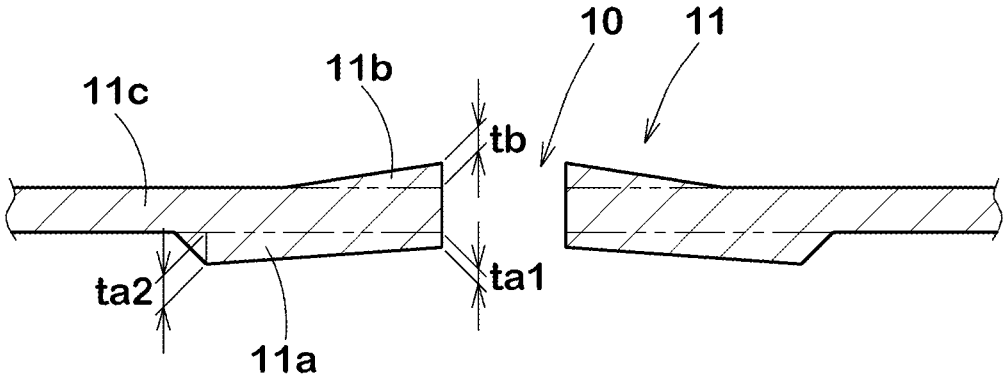

In the Example of FIG. 15, the inside thick portion 11*a* continuously increases from a minimum thickness ta1 on the slit 10 side to a maximum thickness ta2 on the outer edge side of the inside thick portion 11*a*.

The thickness tb of the outside thick portion 11*b* is continuously reduced from the thickness tb on the slit 10 side to the outer edge of the outside thick portion 11*b* and becomes zero.

<<Preferred Slit Position in Toe-Heel Direction in Crown Portion>>

When the crown portion 4 is provided with the slit(s) 10, it is preferable that the slit 10 is provided in one of or each of a region on the toe side of a central region CA and a region on the heel side of the central region CA (shown in FIG. 3) of the crown portion 4. In other words, it is desirable that the slit 10 is not provided in the central region CA of the crown portion 4.

Here, the central region CA of the crown portion 4 is defined as extending 15 mm toward the toe and toward the heel from a straight line FCL which extends in parallel to the front-rear direction passing through a face center FC, as shown in FIG. 3, in the top view of the head.

Also, the face center FC means the geometric center of the area defined by the peripheral edge E of the face portion 2 in the front view as shown in FIG. 2.

It was found that when the ball hitting position deviates from the face center FC toward the toe or heel, the deflection of the crown portion 4 in the toe-heel direction becomes particularly larger on the toe side or the heel side than the central region CA. Therefore, by providing the slit 10 at the position corresponding to such large deflection, it becomes possible to further expand the high repulsion area of the face portion 2 in the toe-heel direction.

<<Preferred Slit Position in Toe-Heel Direction in Sole Portion>>

When the sole portion 5 is provided with the slit(s) 10, it is preferable that a central region CB of the sole portion 5, a region TA of the sole portion 5 on the toe side of the central region CB, and a region HA of the sole portion 5 on the heel side of the central region CB are each provided with the slit 10.

Here, the central region CB of the sole portion 5 is defined as extending 15 mm toward the toe and toward the heel from a straight line FCL which extends in parallel to the front-rear direction passing through the face center FC, as shown in FIG. 4, in the bottom view of the head.

When the ball hitting position is at the face center FC or on the toe side or the heel side of the face center FC, the deflection of the sole portion 5 in the toe-heel direction tends to occur almost evenly in the central region CB, the toe-side region TA, and the heel-side region HA. Therefore, by providing the slits 10 at positions corresponding to such regions, the high resilience region of the sole portion 5 can be further expanded in the toe-heel direction.

While detailed description has been made of preferable embodiments of the present disclosure, the present disclosure can be embodied in various forms without being limited to the illustrated embodiments.

Comparison Tests

Next, more detailed examples of the present disclosure will be described.

As Example 1 of the gold club head according to the present disclosure, a finite element model of the golf club head having two slits in the crown portion and three slits in the sole side as shown in FIGS. 1 to 6 and 11 was prepared, and the coefficient of restitution (COR) at respective positions on the hitting surface of the face portion was calculated through a computer simulation.

Specifically, the hitting surface of the face portion was virtually-divided into matrix areas with a spacing of 5 mm, with a range of 20 mm toward the toe and toward the heel from the face center and 10 mm upward and downward from the face center.

As the COR value of each area of the matrix areas, the average value of the COR values at the four corners of each area of the matrix areas was obtained.

Specifications of the golf club head were as follows.

Example

Head material: Titanium alloy
Head volume: 460 cc
Head mass: 172 grams
Face thickness: 3.7 mm at the center, 2.1 mm at the periphery, the thickness between the center and the periphery was smoothly changed.
Slit width: 2 mm
Slit length: 22 mm
Slits in the crown portion: Two slits extending parallel to the front-rear direction of the head were formed at positions 24 mm apart from the face center toward the toe and heel. The shortest distance D between the slits in the crown portion and the periphery of the face portion was 1.0 mm.
Slits in the sole portion: Three slits extending parallel to the front-rear direction of the head were formed in the center area and at positions 26 mm apart from the face center toward the toe and heel.

Comparative Example

Further, as Comparative example, a finite element model was created from the finite element model of the embodiment by eliminating the thick portion.

<<Calculation of COR>>

COR was calculated according to the "Interim Procedure for Measuring the Coefficient of Restitution of an Iron Clubhead Relative to a Baseline Plate Revision 1.3 Jan. 1, 2006" stipulated by the United States Golf Association (USGA).

Simulation results are shown in Table 1.

TABLE 1

| | | toe | | | | center | hee | | | |
|---|---|---|---|---|---|---|---|---|---|---|
| COR difference | | −20 mm | −15 mm | −10 mm | −5 mm | 0 | 5 mm | 10 mm | 15 mm | 20 mm |
| up | 10 mm | | 0.6 | 0.4 | 0.4 | 0.4 | 0.4 | 0.4 | 0.3 | |
| | 5 mm | 0.7 | 0.4 | 0.1 | 0.0 | 0.0 | 0.1 | 0.2 | 0.3 | 0.2 |
| center | 0 | 0.8 | 0.6 | 0.3 | 0.1 | 0.1 | 0.1 | 0.3 | 0.5 | 0.4 |
| down | −5 mm | 1.1 | 1.1 | 0.9 | 0.8 | 0.6 | 0.6 | 0.7 | 0.8 | 0.8 |
| | −10 mm | | 1.4 | 1.5 | 1.4 | 1.4 | 1.2 | 1.2 | 1.2 | |

Table 1 shows values (×1000) obtained by subtracting the COR of the comparative example from the COR of Example 1 for each matrix area, wherein a larger numerical value means that the COR of Example 1 was improved as compared to Comparative Example.

As can be seen from Table 1, it was confirmed that the COR of the face portion of the head of Example 1 was significantly increased in almost the entire range in the toe-heel direction and the up-down direction as compared with the head of the comparative example.

Next, simulation models of golf club heads having thick portions with cross-sectional shapes shown in FIGS. 12 to 15 were created (Examples 2 to 5), and analyzed with respect to the distribution of stress generated around the slit when hitting a ball, together with Example 1 and Comparative Example.

FIGS. 16A-16F show stress distributions around slits. In FIGS. 16A-16F, the upper side is the front end side of the slit.

Table 2 shows the average stress around the slit.

Table 2

TABLE 2

| | Comparative Example | Example 1 | Example 2 | Example 3 | Example 4 | Example 5 |
|---|---|---|---|---|---|---|
| thick portion (FIG. No.) | none | 11 | 12 | 13 | 14 | 15 |
| head weight (g) | 173.00 | 173.46 | 173.36 | 173.37 | 173.40 | 173.28 |
| maximum stress around slit (MPa) | 1565 | 929 | 1028 | 946 | 913 | 932 |
| average stress around slit (MPa) | 1076 | 801 | 776 | 852 | 835 | 853 |

Figure 16A:
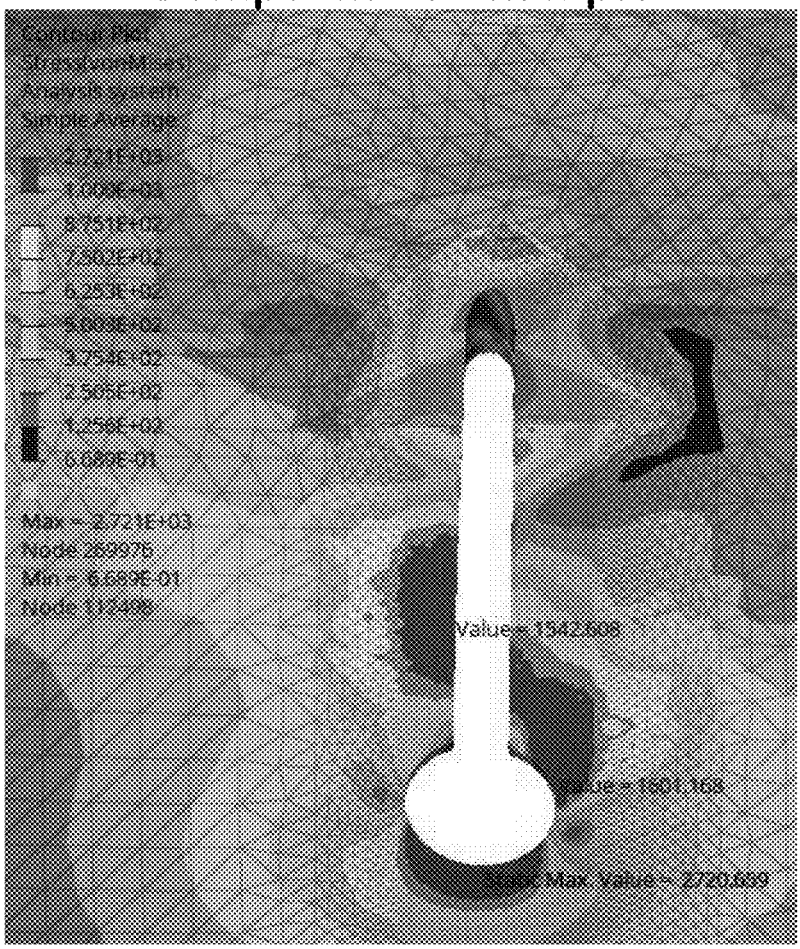
FIGS. 16A-16F show stress distribution maps around various slits.

In FIG. 16A showing Comparative Example, high-stress portions (dark-colored portions) occurred so as to contact with the front, rear, and both sides of the slit.

In Comparative Example, the maximum stress was 1565 MPa around the slit, and the average stress was 1076 MPa.

Figure 16B:
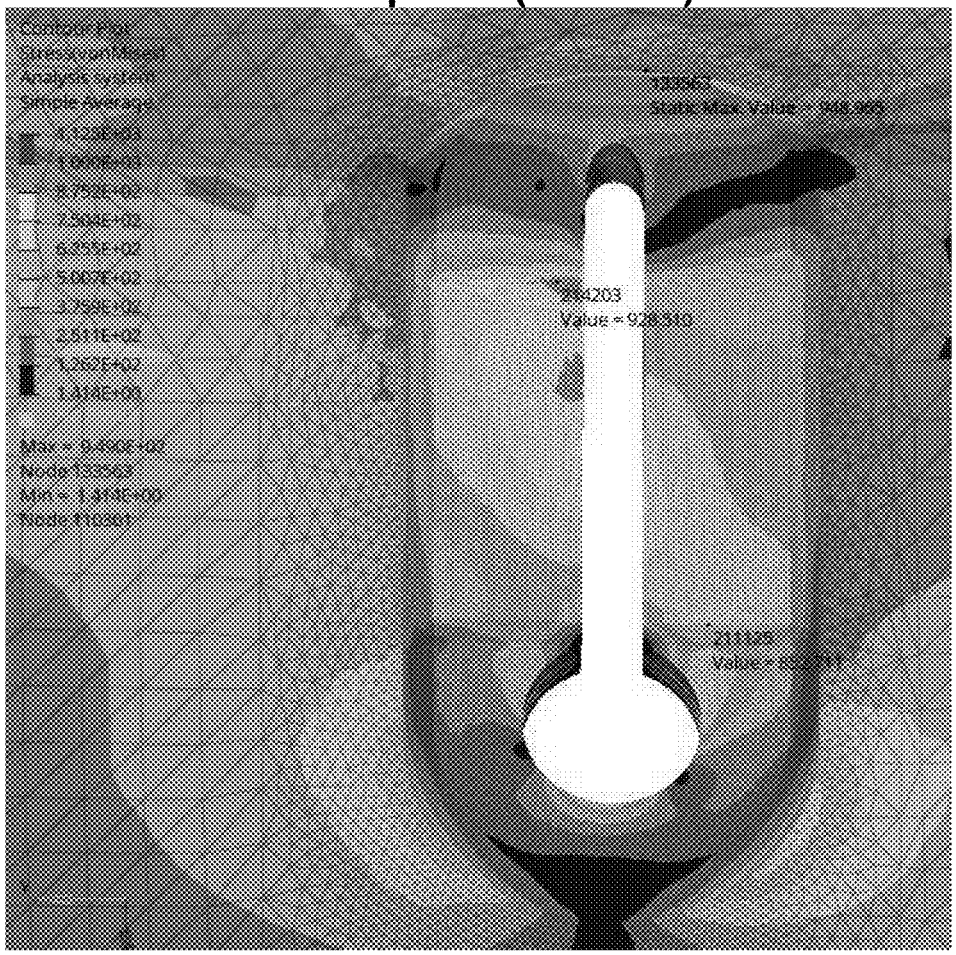
Figure 16C:
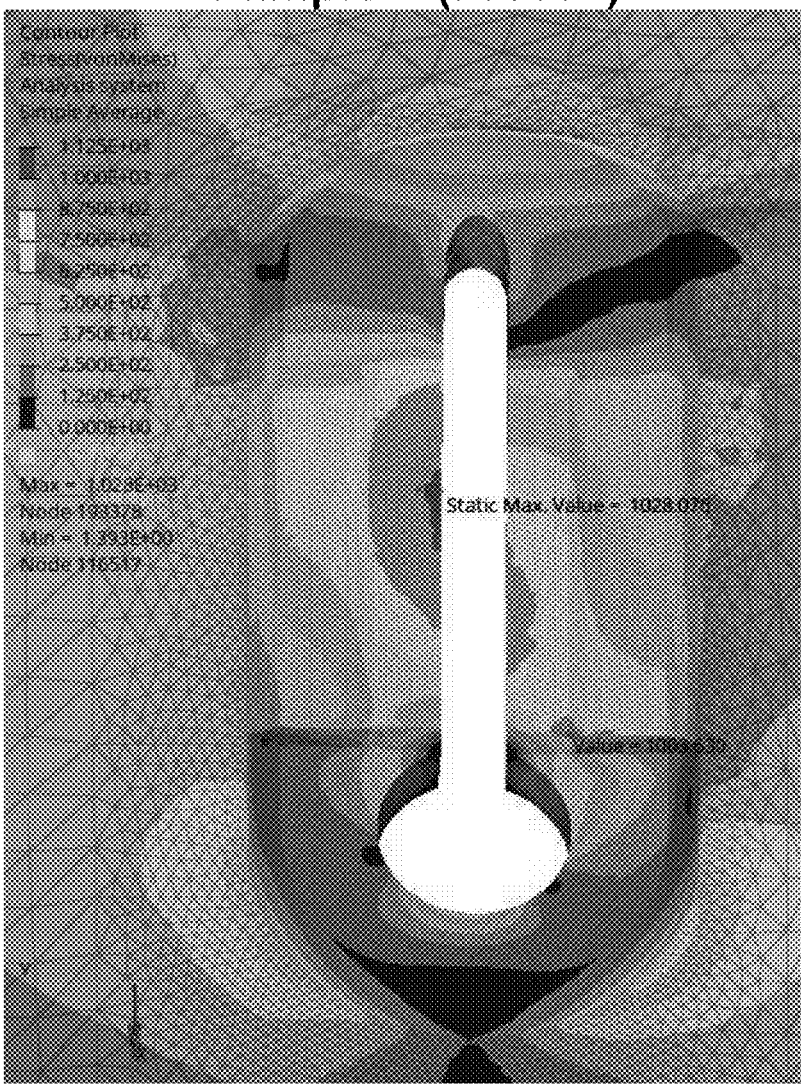
Figure 16D:
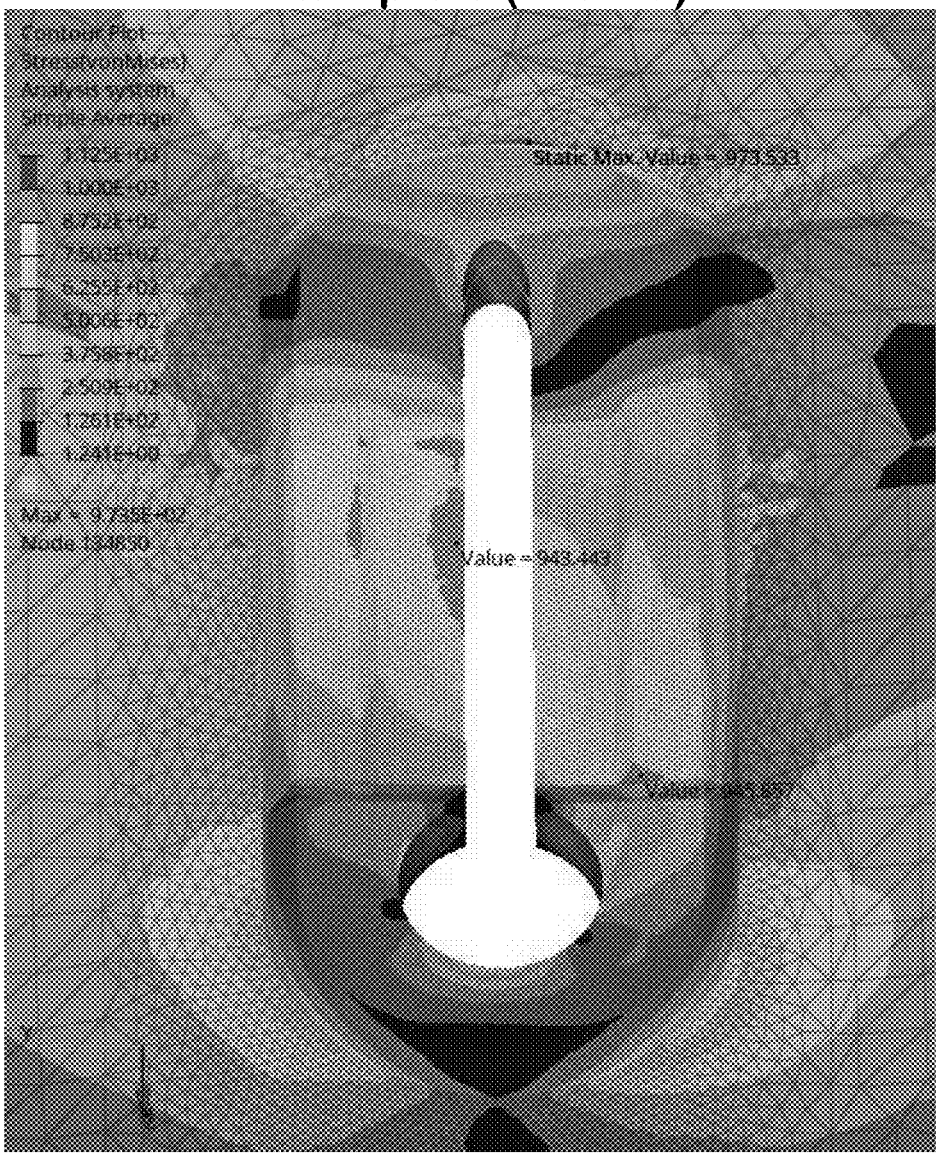
Figure 16E:
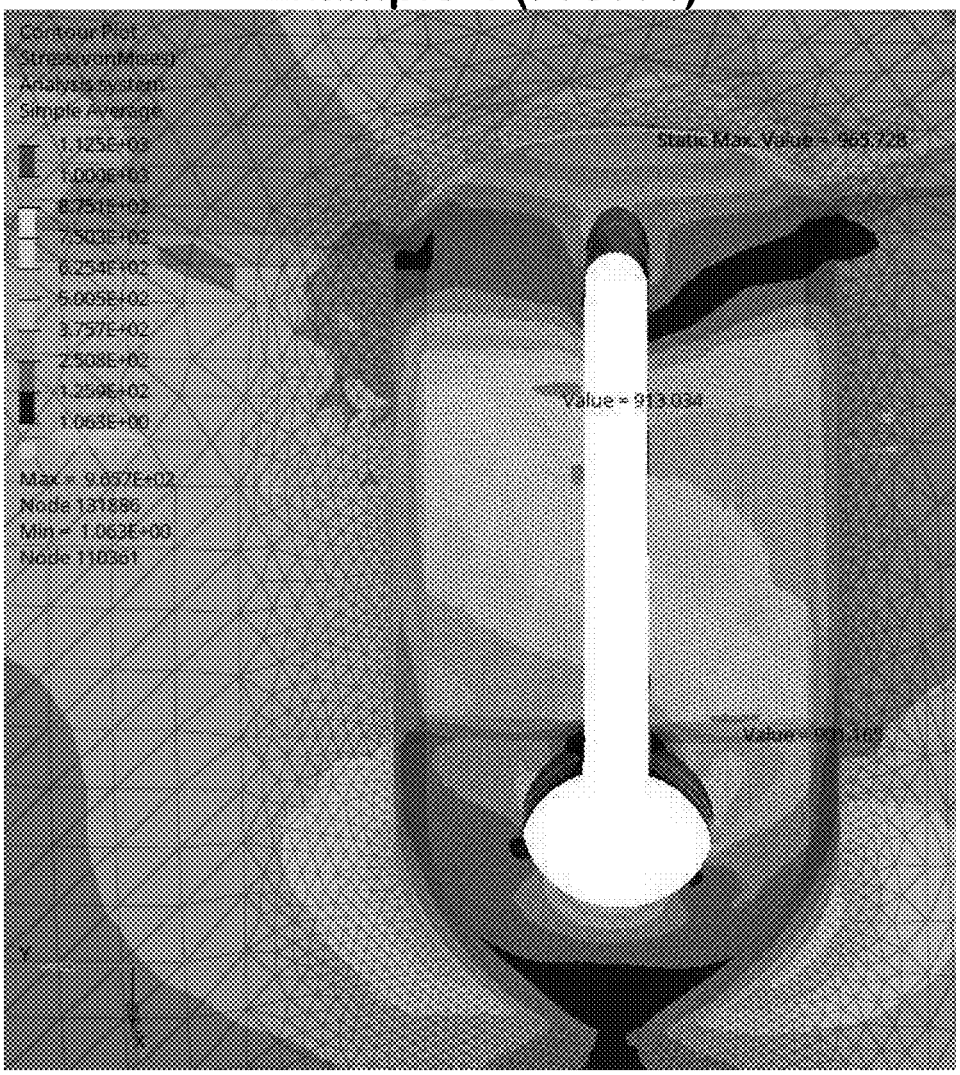
Figure 16F:
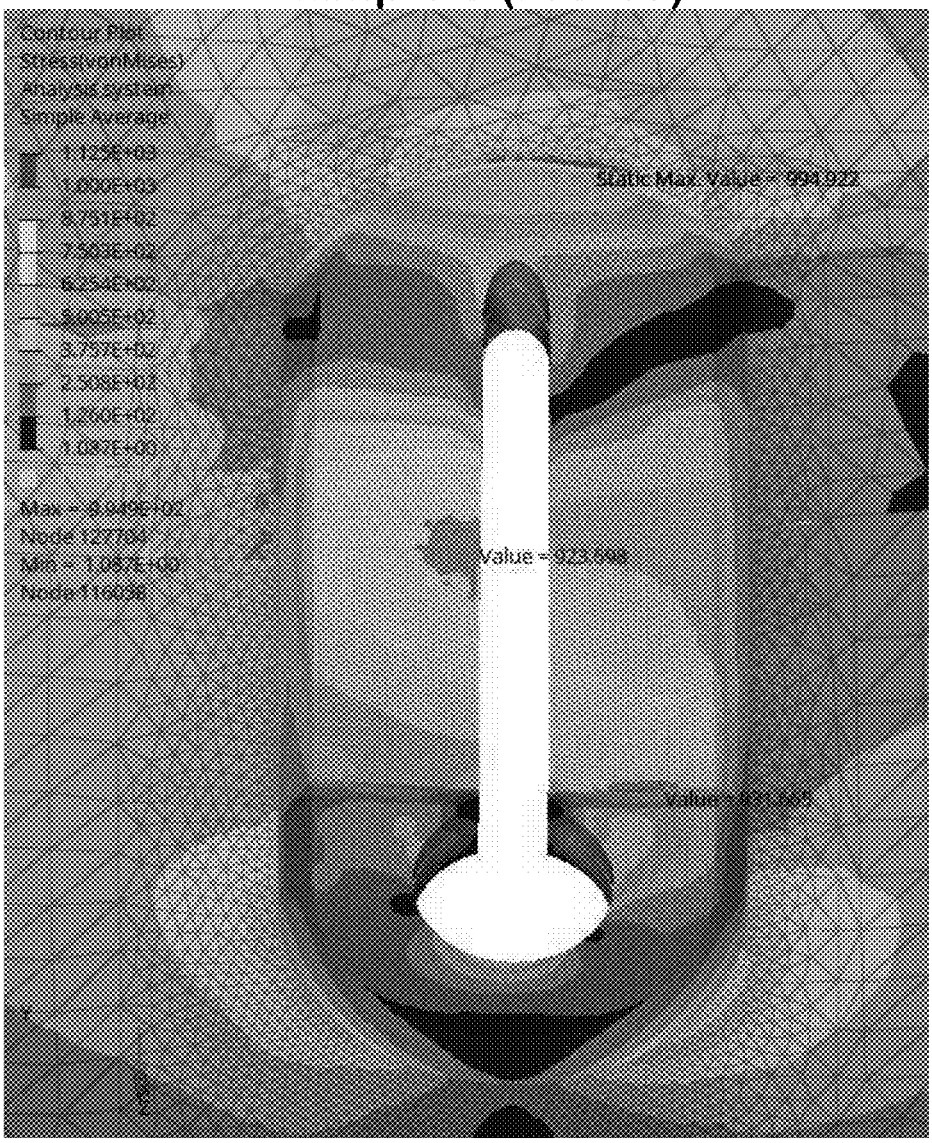

In FIG. 16B showing Example 1, high-stress portions as in the comparative examples were not occurred around the slit.

Note that in the stress distribution diagram of Example 1, the black-colored portion extending from the vicinity of the front end of the slit to the right side, indicates a portion where the stress is extremely small.

In Example 1, the maximum stress around the slit was reduced to 929 MPa and the average stress was reduced to 801 MPa while suppressing an increase in head weight as compared with Comparative Example.

It can be confirmed that, in Examples 2 to 5 (shown in FIGS. 16C to 16F, respectively) as well, the maximum stress and average stress around the slit were reduced compared to Comparative example.

Statement of the Present Disclosure

The present disclosure is as follows:

Disclosure 1: A golf club head having a hollow therein and comprising: a face portion, and a main body portion including a crown portion and a sole portion both extending backwardly of the head from the face portion, wherein the main body portion is provided with a slit penetrating through the main body portion, the slit has a width in the toe-heel direction of the head and a length in the front-rear direction of the head which is larger than the width, and a surrounding area of the slit is at least partially provided with a thick portion.

Disclosure 2: The golf club head according to Disclosure 1, wherein the shortest distance between a peripheral edge of the face portion and a front end of the slit in the front-rear direction of the head is 10 mm or less.

Disclosure 3: The golf club head according to Disclosure 2, wherein said shortest distance is 3 mm or less.

Disclosure 4: The golf club head according to any one of Disclosures 1 to 3, wherein one of or each of front and rear ends of the slit in the front-rear direction of the head has an arcuate outline.

Disclosure 5: The golf club head according to any one of Disclosures 1 to 4, wherein the slit has front and rear ends in the front-rear direction of the head, and the width of the slit is larger on the rear end side than on the front end side.

Disclosure 6: The golf club head according to Disclosure 5, wherein the slit comprises a first portion extending backwardly of the head from the front end, and a second portion connected to the first portion and having a circular contour.

Disclosure 7: The golf club head according to any one of Disclosures 1 to 6, wherein the length of the slit is 10 mm to 40 mm and the width of the slit is 0.5 to 10 mm.

Disclosure 8: The golf club head according to any one of Disclosures 1 to 7, wherein the thick portion is formed annularly so as to surround the slit.

Disclosure 9: The golf club head according to any one of Disclosures 1 to 8, wherein the thick portion includes an inside thick portion protruding toward the hollow.

Disclosure 10: The golf club head according to any one of Disclosures 1 to 9, wherein the thick portion includes an outside thick portion protruding toward the outside of the head.

Disclosure 11: The golf club head according to any one of Disclosures 1 to 10, wherein the slit is provided in one of or each of the crown portion and the sole portion.

Disclosure 12: The golf club head according to any one of Disclosures 1 to 11, wherein the slit is provided in the crown portion, and the slit is disposed in one of or each of a region on the toe side and a region on the heel side of a central region of the crown portion, wherein the central region is defined as extending 15 mm toward the toe and toward the heel from a straight line drawn parallel to the front-rear direction passing through the face center in the top view of the head.

Disclosure 13: The golf club head according to any one of Disclosures 1 to 12, wherein the slit is provided in the sole portion, and the slit is disposed in each of a central region, a region on the toe side of the central region and a region on the heel side of the central region, wherein the central region is defined as extending 15 mm toward the toe and toward the heel from a straight line drawn parallel to the front-rear direction passing through the face center in the bottom view of the head.

DESCRIPTION OF THE REFERENCE SIGNS

1 head
2 face portion
3 main body portion
4 crown portion
5 sole portion
10 slit
10*a* slit front end
10*b* slit rear end
11 thick portion
11*a* inside thick portion
11*b* outside thick portion
101 first portion
102 second portion
CA central region
D shortest distance
E peripheral edge of face portion
FC face center
FCL line in front-rear direction of head
i hollow

The invention claimed is:

1. A golf club head having a hollow therein and comprising:

a face portion, and a main body portion including a crown portion and a sole portion both extending backwardly of the head from the face portion, wherein the main body portion is provided with a slit penetrating through the main body portion, the slit has a width in the toe-heel direction of the head and a length in the front-rear direction of the head which is larger than the width, and a surrounding area of the slit is at least partially provided with a thick portion, wherein the thick portion includes an outside thick portion protruding toward the outside of the head.

2. The golf club head according to claim 1, wherein the shortest distance between a peripheral edge of the face portion and a front end of the slit in the front-rear direction of the head is 10 mm or less.

3. The golf club head according to claim 2, wherein said shortest distance is 3 mm or less.

4. The golf club head according to claim 1, wherein one of or each of front and rear ends of the slit in the front-rear direction of the head has an arcuate outline.

5. The golf club head according to claim 1, wherein the slit has front and rear ends in the front-rear direction of the head, and the width of the slit is larger on the rear end side than on the front end side.

6. The golf club head according to claim 5, wherein the slit comprises a first portion extending backwardly of the head from the front end, and a second portion connected to the first portion and having a circular contour.

7. The golf club head according to claim 1, wherein the length of the slit is 10 mm to 40 mm, and the width of the slit is 0.5 to 10 mm.

8. The golf club head according to claim 1, wherein the thick portion is formed annularly so as to surround the slit.

9. The golf club head according to claim 1, wherein the thick portion includes an inside thick portion protruding toward the hollow.

10. The golf club head according to claim 1, wherein the slit is provided in one of or each of the crown portion and the sole portion.

11. The golf club head according to claim 1, wherein the slit is provided in the crown portion, and the slit is disposed in one of or each of a region on the toe side and a region on the heel side of a central region of the crown portion, wherein the central region is defined as extending 15 mm toward the toe and toward the heel from a straight line drawn parallel to the front-rear direction passing through the face center in the top view of the head.

12. The golf club head according to claim 1, wherein the slit is provided in the sole portion, and the slit is disposed in each of a central region, a region on the toe side of the central region and a region on the heel side of the central region, wherein the central region is defined as extending 15 mm toward the toe and toward the heel from a straight line drawn parallel to the front-rear direction passing through the face center in the bottom view of the head.

13. A golf club head having a hollow therein and comprising:

a face portion, and a main body portion including a crown portion and a sole portion both extending backwardly of the head from the face portion, wherein the main body portion is provided with a slit penetrating through the main body portion, a surrounding area of the slit is at least partially provided with a thick portion, and the shortest distance between a peripheral edge of the face portion and a front end of the slit in the front-rear direction of the head is 10 mm or less, wherein the thick portion includes an outside thick portion protruding toward the outside of the head.

14. The golf club head according to claim 13, wherein the thick portion is formed annularly so as to surround the slit.

15. The golf club head according to claim 13, wherein the thick portion includes an inside thick portion protruding toward the hollow.

16. The golf club head according to claim 13, wherein the slit is provided in one of or each of the crown portion and the sole portion.

17. The golf club head according to claim 13, wherein the slit is provided in the crown portion, and the slit is disposed in one of or each of a region on the toe side and a region on the heel side of a central region of the crown portion, wherein the central region is defined as extending 15 mm toward the toe and toward the heel from a straight line drawn parallel to the front-rear direction passing through the face center in the top view of the head.

18. The golf club head according to claim 13, wherein the slit is provided in the sole portion, and the slit is disposed in each of a central region, a region on the toe side of the central region and a region on the heel side of the central region, wherein the central region is defined as extending 15 mm toward the toe and toward the heel from a straight line drawn parallel to the front-rear direction passing through the face center in the bottom view of the head.

* * * * *